US006250241B1

(12) United States Patent
Spengler

(10) Patent No.: US 6,250,241 B1
(45) Date of Patent: Jun. 26, 2001

(54) SUPPORTING FRAME FOR A SAILING RIG

(76) Inventor: Bernd Spengler, Guenthersbuehlerstrasse 43, 90419 Nuremberg (DE)

( * ) Notice: Subject to any disclaimer, the term of this patent is extended or adjusted under 35 U.S.C. 154(b) by 0 days.

(21) Appl. No.: 09/367,608

(22) PCT Filed: Feb. 13, 1998

(86) PCT No.: PCT/DE98/00437

§ 371 Date: Sep. 1, 1999

§ 102(e) Date: Sep. 1, 1999

(87) PCT Pub. No.: WO98/43874

PCT Pub. Date: Oct. 8, 1998

(30) Foreign Application Priority Data

Apr. 1, 1997 (DE) ..... 197 13 454

(51) Int. Cl.[7] ..... B63H 9/04
(52) U.S. Cl. ..... 114/102.11
(58) Field of Search ..... 114/102.1, 102.11, 114/108, 89, 90, 97, 39.12, 39.16

(56) References Cited

U.S. PATENT DOCUMENTS

| | | | |
|---|---|---|---|
| 3,768,832 | 10/1973 | Goldberg . | |
| 4,563,969 | 1/1986 | Le Bail . | |
| 5,372,081 * | 12/1994 | Mayer | 114/102.11 |
| 5,448,961 | 9/1995 | Antseensen . | |
| 5,826,530 * | 10/1998 | Tuurna et al. | 114/102.11 |

FOREIGN PATENT DOCUMENTS

| | | |
|---|---|---|
| 29 00 681 | 4/1982 | (DE) . |
| 32 15 668 | 4/1982 | (DE) . |
| 32 08 340 | 9/1982 | (DE) . |
| 0 152 306 | 8/1985 | (EP) . |
| 0 152 306 B1 | 9/1988 | (EP) . |
| 0 152 306 B1 | 11/1988 | (EP) . |
| 2 464 881 | 3/1981 | (FR) . |
| WO 82/03053 | 9/1982 | (WO) . |
| WO 95/05973 | 3/1995 | (WO) . |

* cited by examiner

*Primary Examiner*—Stephen Avila
(74) *Attorney, Agent, or Firm*—Oliff & Berridge, PLC.

(57) ABSTRACT

What is disclosed is a supporting frame for a hand-supported sailing rig in which a mast with a middle section curved in a preferably circular arc-shaped manner and merging into two end portions is formed, the radii of curvature of said end portions being smaller than the one of the middle section. The supporting frame has supporting means for supporting the rig at the body of the user. The middle section is preferably provided with a joint device which allows the arrangement of the supporting components in the folded state in a parallel orientation towards each other.

15 Claims, 5 Drawing Sheets

SUPPORTING FRAME FOR A SAILING RIG

Figure 1:
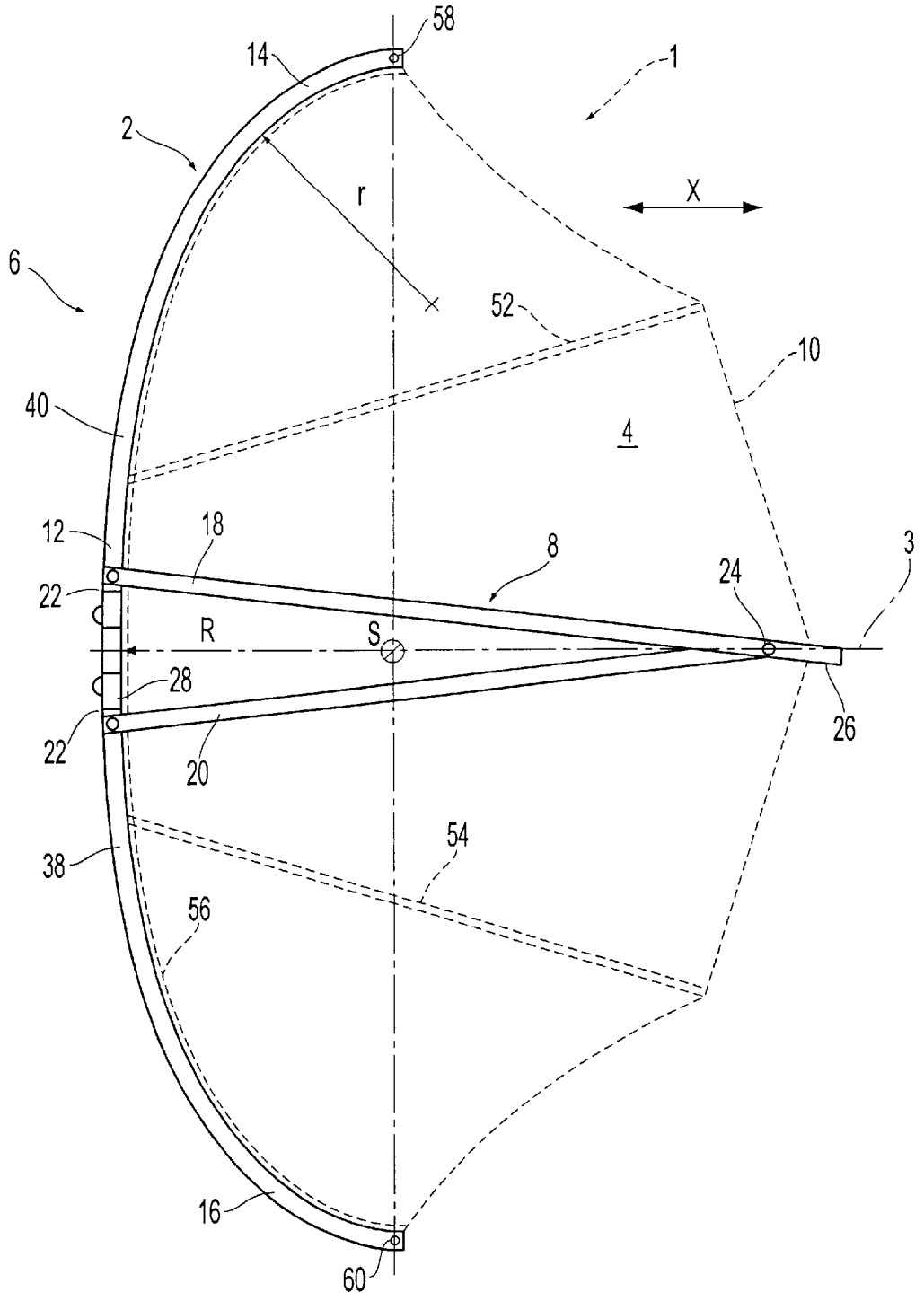

The present invention refers to a supporting frame for a hand-supported sailing rig in accordance with the preamble of claim 1 and a sailing rig provided with such a supporting frame.

A sailing rig with such a supporting frame is also termed "wingsail" and can for example be used by ice skaters or roller skaters who use this sailing rig in a manner similar to a wind surfer so that they can use wind force for propulsion.

Such a known rig is for example disclosed in the PCT application Wo 95/05973. In the case of this known solution, the rig comprises a supporting frame with two mast tubes which are positioned against each other like an arrow in the rigged state and which are connected via a joint device. At each end section of the two mast tubes, elastic extensions are formed which act similar to a batten in order to stretch the sail. For holding the sail, a cross bar is coupled in the joint area between the two mast tubes, which extends from the joint device to the trailing edge of the sail. The cross bar is supported via V-shaped supports at the respective mast tube. The free end section of the cross bar is connected with the trailing edge for stretching the sail.

This sailing rig is held by the ice skater or the roller skater without support so that the holding forces to be exerted by the user are relatively high.

A further disadvantage of the known structure is to be seen in the circumstance that the supporting structure for supporting the cross bar and the coupling of the cross bar and the connection of the two mast tubes by means of the joint device necessitates a large expense in terms of device technology since a large number of components, such as for examples coupling sleeves and joint connections, have to be provided in order to couple these components with the necessary rigidity. The complexity of the structure also necessitates some practise and time for bringing the known sail from the folded transport state to the ready-to-sail state.

From EP 0152306B1 a rig for skies is known which are provided with receptacles for the mast ends. Such a construction is not provided for the use with ice skates or roller skates.

In contrast, it is the object underlying the invention to provide a sailing rig and a supporting frame for a hand-supported sailing rig which can be easily handled under a minimum of expense in terms of device technology.

This object is attained in view of the supporting frame by the features of claim 1 and as regards the sailing rig by the features of claim 15.

In the supporting frame according to the invention, the end sections of a mast are provided with support means so that the rig can be supported during sailing on the foot, the ice skate or the roller skate or somewhere else on the user and thus, the holding force does not have to be completely exerted by the arms of the user. The support via one of the two end sections also allows it in a simple way to fend off gusts of wind since it is only the hand which is closer to the trailing edge which has to be released so that the rig can blow about an axis running through the support point and thus no extensive wind pressure is transmitted, which can lead to a fall in unfavourable cases. Since the support occurs at the body of the user, no receptacles have to be provided at the ice skates or at other sporting devices.

It is preferred to form the U- or V-shaped structure of the mast by a middle section with subsequent curved end portions. Although the end portions have a certain inherent elasticity, they can still have about the same flexural strength as the middle portion of the mast.

A particularly good flow acting on the rig is achieved when the middle section is curved in the shape of a circular arc with the radius of curvature of the middle section being larger than that of the two end sections. Naturally, other geometries of curvature, such as for example elliptical curvatures, etc. can be provided instead of a circular arc-shaped curvature of the end portions and the middle portion.

A particularly easy stretching of the sail and a safe handling of the sailing rig can be achieved when the holding means is designed with two V-shaped boom struts meeting at the trailing edge. These boom struts are coupled with the middle section of the mast with their front ends which are distant from the trailing edge. The V-shaped structure of the holding means enables the user to hold the rig below the sail's pressure point so that the top of the sail is pushed away from the skater by the pressure of the wind and the mast is pressed against the body with its support means and thus an optimum three-point-support of the rig is guaranteed.

In order to allow folding of the sailing rig, the middle section is provided with a joint device which divides said middle portion into an upper and a lower mast middle portion. A particularly stable joint device with a simple structure is obtained when said joint device comprises a base portion which is coaxially arranged in relation to the mast and has two spaced joints at which the first mast middle portion and the second mast middle portion are coupled.

Alternatively to the joint device, the division of the mast can also be realised by an inserted connection or a similar structure.

The support in the ready-to-sail state is particularly stable when the base portion has a supporting shell at each end section, which overlaps with the respective allocated mast middle portion so that said portion is supported by the supporting shell.

The back end portions of the boom strut are advantageously connected with each other such as to be disconnectable.

The storing space needed for the folded sail is minimal when the two end portions are likewise coupled with the middle section of the mast such as to be disconnectable.

The sailing rig can be handled in a particularly easy manner when a supporting strut is arranged at each of the free ends of the mast, said supporting strut extending away from the mast. Said supporting strut can then, for example, be supported on the instep of the user's foot.

At the end section distant from the mast of the holding means, an end fitting is provided which allows stretching of the sail's trailing edge.

The swivelling axis of the joint device and the coupling of the boom struts at the mast are selected such that the mast portions and the boom struts are approximately parallel in the folded state.

The curvature and the length of the two mast end portions and optionally the mast middle section are preferably designed such that a connecting line between the two mast ends approximately intersects the sailns pressure point.

Further advantageous developments of the invention are the subject matters of further subclaims.

Figure 2:
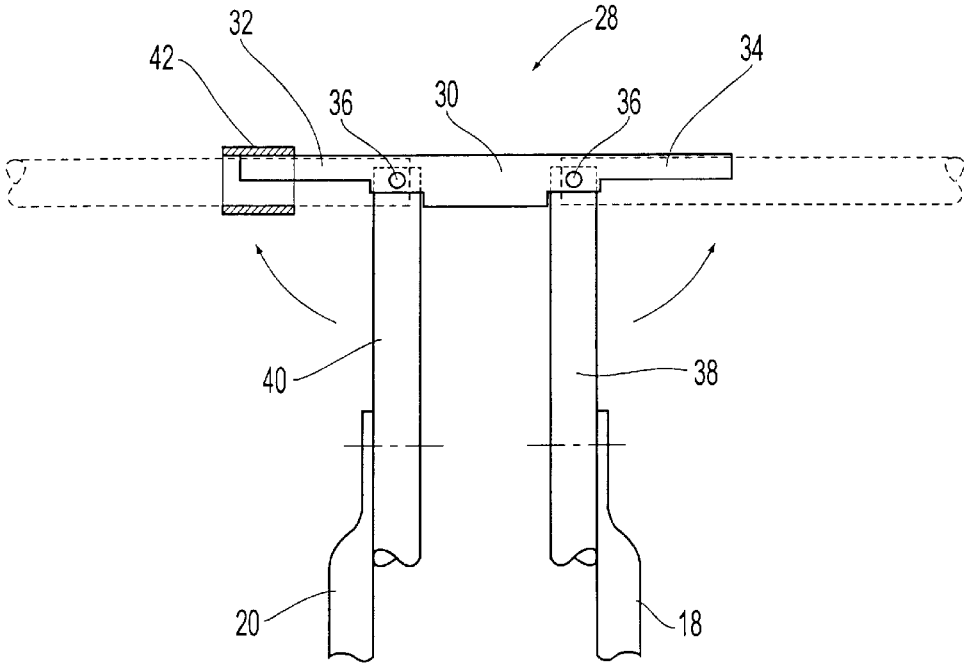
Figure 3:
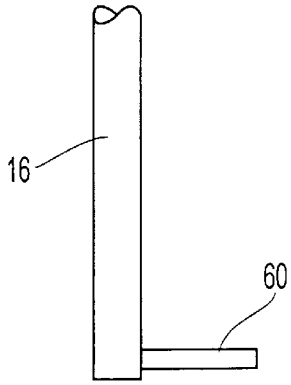
Figure 4:
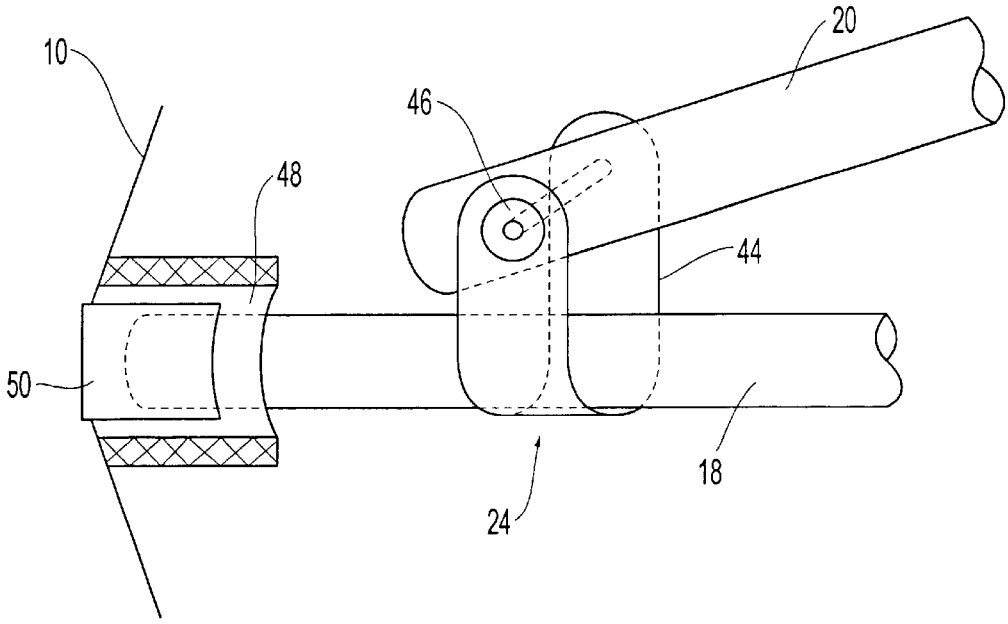
Figure 5:
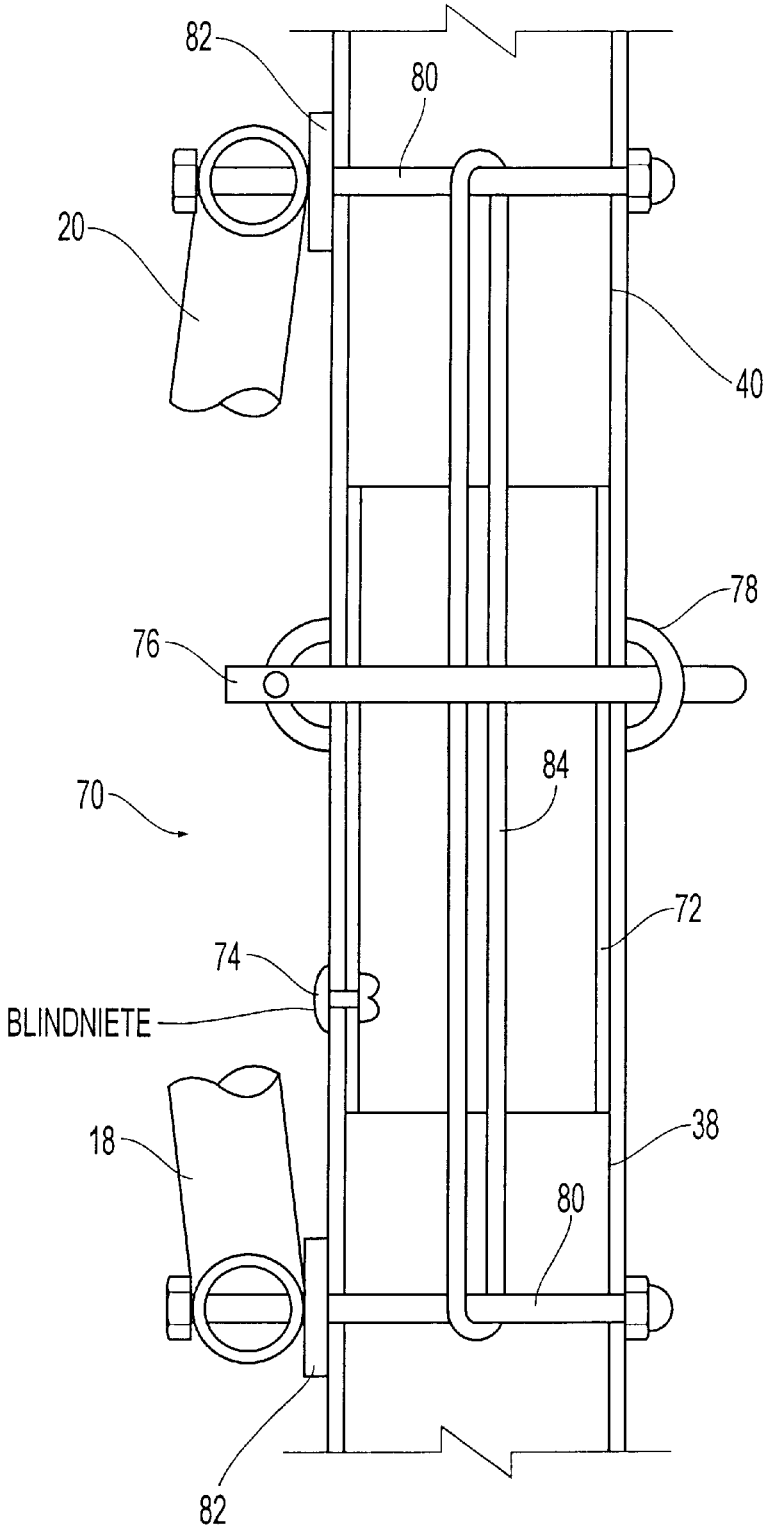
Figure 6:
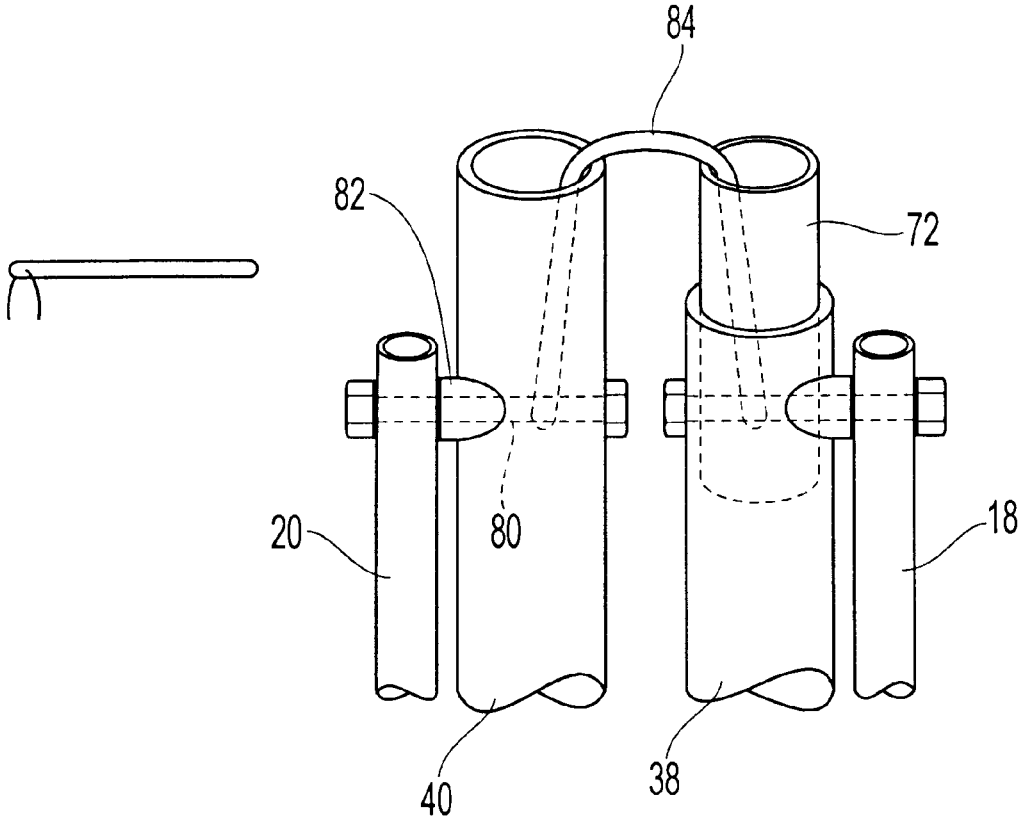

In the following, a preferred embodiment of the invention is explained in more detail using schematic drawings. It is shown in FIG. 1, a view of the rig in the ready-to-sail state;

FIG. 2, a detailed side view of the rig of FIG. 1 in the folded state;

FIG. 3, a side view of a mast end section;

FIG. 4, the trailing edge-side end of a holding means of the rig of FIG. 1;

FIG. 5, an alternative connecting member via which the mast can be divided into at least two parts and FIG. 6, the connecting member in the folded state.

FIG. 1 shows a view on a supporting frame 2 made of aluminum tubing of a sailing rig 1, at which a sail 4, indicated by the broken line, can be attached. The supporting frame 2 according to the invention has a mast 6 and a holding means 8 which extends from the mast 6 towards the trailing edge 10 of the sail.

In the embodiment shown, the mast 6 has a middle section 12 which is curved with a radius of curvature R in the embodiment shown. The two end sections, in FIG. 1 the upper and lower ones, of the mast 6 are likewise curved in a circular arc shape, with the radius of curvature r being smaller than that of the middle section 12. These end sections are formed by tube-shaped end portions 14, 16 which are connected with the middle section 12 in a suitable manner. A possible connection can for example occur by a push-pin-system or by inserting a tapered section of the end portions 14, 16 in a corresponding receptacle of the middle section 12.

The holding means 8 has two boom struts 18, 20 which are v-shaped and which are coupled at the middle section 12 of the mast 6 via suitable joints 22 with their spaced end sections shown in FIG. 1 on the left-hand side. The other end section of the boom struts 18, 20 is combined via a connecting means 24 the structure of which will be explained in the following.

The sailing rig 1 shown in FIG. 1 has a structure symmetrical to a middle axis 3 (parallel to the plane of drawing in FIG. 1).

In the embodiment shown in FIG. 1, the upper boom strut 18 is designed somewhat longer than the lower boom strut 20 so that the former extends to the trailing edge 10 or beyond it. At this end of the boom strut 18, an end fitting 26 is provided via which the trailing edge 10 can be impinged upon with a tractive force in order to adjust the sail profile.

The middle section 12 of the mast 6 is designed with a joint device 28 which allows folding of the mast 6. The structure of this joint device is shown in FIG. 2.

FIG. 2 shows a side view in the joint device 28 in FIG. 1. Accordingly, said device comprises a tube-shaped base portion 30 at which two mast middle portions 38, 40 are coupled. The two mast middle portions 38, 40 and the joint device 28 together form the middle section 12. The two mast middle portions 38, 40 are shown in FIG. 2 in the folding position, the extended position corresponding to FIG. 1 is indicated in broken lines. As can be taken from FIG. 2, the casing section in the area of the end sections of the base portion 30 is excised in the longitudinal direction so that two supporting shells 32, 34 are formed which overlap the corresponding end sections of the mast middle portions 38, 40 in the extended position (broken line).

The casing of the supporting shells 32, 34 is enlarged in the area of the coupling of the mast middle portions 38, 40 in the circumferential direction, so that a receptacle for hinge pins 36 is formed via which the first or the second mast middle portion 38, 40 is coupled, respectively.

The fixing of the two mast middle portions 36, 38 coaxially to the base portion 30 occurs, for example, via suitable sliding sleeves 42 which create a positive connection of the mast middle portions with the base portion 30. Instead of the sliding sleeves 42, other connecting means, such as for example a Velcro tape, a pin construction or the like can be used.

In order to arrange supporting frame 2 in the extended position shown in FIG. 1, the two mast middle portions 38, 40 are swivelled upward so that the mast takes the position shown in FIG. 1. Subsequently, the two boom struts 18, 20 are placed in a position which is approximately horizontal to the plane of drawing of FIG. 2 so that the end sections of boom struts 18, 20 can be combined via the connecting means 24.

An embodiment of this connecting means is shown in FIG. 4. It shows a detailed representation of the part arranged in the trailing edge area of the holding means 8.

Accordingly, the connecting means 24 has a U-shaped mounting strap 44 which encompasses the longer boom strut 18 with its base and is fixed thereon so that the two legs protrude upwardly toward the other boom strut 20. The two end sections are provided with two aligned through holes so that a quick acting closure pin 46, for example a so-called quickpin or a through pin with a rubber loop securing as is customarily used in boat rigs, can be inserted. This quick acting closure pin 46 passes through the boom strut 20 so that said boom strut 20 is in fixed position to the other boom strut 18.

The end of the longer boom strut 18 is inserted in a pocket 48 sown on the trailing edge 10 of the sail 4 and is fixed by means of a Velcro fastener 50. In principle, this is the same kind of fixing as is for example used for fixing battens in the case of surf sailing. Of course, other fastening systems can also be imagined. What is important is that the trailing edge 10 can be fixed at the holding means 8 with a sufficient pre-tension. It is also possible to extend boom strut 18 beyond the trailing edge 10 and to tension the latter by means of tackle. Such trailing edge tensioning devices are for example used in the case of surf wishbone booms.

By inserting the boom strut 18 into the pocket 48, the trailing edge is tensioned so that the desired sail profile can be adjusted. Forming the desired profile can be supported by arranging battens 52, 54 which are supported by corresponding end fittings or cambers at the mast 6.

As is shown in broken line in FIG. 1, mast 6 passes through a mast pocket 56 of sail 4 with the end sections of the mast pocket 56 being preferably closed by a Velcro or the like in order to prevent a relative shifting of the mast 6 with respect to the sail 4.

In FIGS. 5 and 6, an embodiment of mast 6 is represented wherein an inserted connection 70 is used for connecting the mast middle portions 38, 40 instead of a joint device.

In this inserted connection 70, a plug-in sleeve 72 is inserted in the adjacent end sections of the mast middle portion 38 with the outer diameter of the plug-in sleeve 72 being somewhat smaller than the inner diameter of the tube for the mast middle portion 38. The plug-in sleeve 72 is fastened in the mast middle portion 38 by means of rivets 74 passing through the two casings of the overlapping tubes. In the mounting position, the plug-in sleeve 72 protrudes from the mast middle portion 38 with the right end section in FIG. 5. Onto this protruding section of the plug-in sleeve 72, the other mast middle portion 40 is pushed and fastened by means of a socket pin 76 which passes through the plug-in sleeve 72 and the mast middle portion 40 in the radial direction. In the embodiment shown, the socket pin 76 is secured by a rubber band 78 in its through position, said rubber band encompassing half of the circumference of the mast middle portion 40.

In the embodiment shown in FIG. 5, the boom struts 18, 20 are fastened at the hinge pins 80, with a saddle piece 82 each being provided as a slide bearing between a boom strut 18, 20 and the corresponding mast middle portion 40 or 38, respectively, so that a direct contact of the boom struts 18, 20 at the mast middle portions 38, 40 is prevented. The hinge pins 80 pass through the respective mast middle portion 38 or 40 and the appertaining boom strut 18 or 20, respectively. For fixing the position of the inserted connection, an elastic tension strap 84 stretches between the two hinge pins, by means of which the two mast middle portions 38, 40 are tensioned toward each other and thus are also fixed in position without the socket pin 76.

For folding the supporting frame, the socket pin 76 is pulled out in the radial direction and the mast middle portion 40 is pulled in the axial direction from the projecting section of the plug-in sleeve 72 against the pre-tension of the tension strap 84 so that the two mast middle portions 38, 40 can be brought into a parallel 30 position by swivelling about 90°.

FIG. 6 shows the inserted connection in the folded state. The parts are hereby elastically connected via the tension strap 84 so that this practically forms a joint device. By the overlapping of the plug-in sleeve 72 with the mast middle portion 40, a deflection resistant connection is guaranteed. As can be taken from the representation according to FIG. 6, the contact surfaces of the saddle pieces 82 contacting the respective mast middle portions 38 or 40 are curved according to the outer diameter of the mast middle portions 38, 40 so that the saddle pieces 82 are in level contact with the outer diameter. The contact surfaces of the saddle pieces 82 facing the boom struts 18, 20 are designed evenly so that a swivelling of the boom struts 18, 20 is possible.

Of course, instead of the inserted connection shown in FIGS. 5 and 6, or instead of the joint device in FIG. 2, other suitable connections can be provided for the components of the mast.

In the rigged state, a line of connection runs between the ends of the two end portions 14, 16 (shown in dash-dotted line in FIG. 1) approximately through the sail's pressure point S of the sail 4. At the end sections of the end portions 14, 16 supporting struts 58, 60 are provided which extend vertically to the plane of drawing in the representation according to FIG. 1.

FIG. 3 shows a view from the front, i.e. from mast 6 towards the rig shown in FIG. 1 in the area of the end portion 16. The supporting struts 58, 60 can be designed for example as freely projecting straight or curved pins or in another manner, for example provided with foot loops. It is the object of this arbitrarily formed support device to support the complete rig on the foot or on another part of the user's body. The line of application of the supporting force acting on the supporting struts 58, 60 runs approximately along the dash-dotted line through the sail's pressure point S so that the angle of attack of the wind can be adjusted in an optimum manner by the user.

During skating, the user holds the rig essentially at the boom strut 20 which is lower in FIG. 1. The end section of mast 6 which is on the side of the foot is supported via the supporting device—here the support strut 60—at the shoe of the user. Since the boom strut 20 lies below the sail's pressure point S, the top of the mast (end portion 14) is tilted leeward by the wind pressure and the mast portion on the side of the foot is pressed against the foot of the user via the support strut 60. In this manner a secure three-point-support of the rig at the body is guaranteed and the holding forces at the boom strut 20 are reduced to a minimum.

In the normal skating position, the rig 1 is for example supported on the foot of the user with the support strut 60, while the user holds the rig at the boom strut 18, 20. In this—in the position shown in FIG. 1, i.e. in case of a flow from the side of the viewer—the left hand is arranged on the left side of the sail's pressure point S and the right hand is arranged on the right side of the sail's pressure point S. By swivelling the rig in the direction of the arrow X (parallel to the plane of drawing), the direction of motion can be adjusted relative to the wind (falling off or luffing). In case of strong gusts or very strong wind pressure, the rig can be swivelled around the dash-dotted axis so that the trailing edge 10 swivels away from the user and the sail 4 is positioned in a sharper angle to the wind. In order to change the direction of motion (turning around), the sail is for example positioned into the wind and then swivelled to the other side over the head of the skater so that the support strut 58 is then arranged at the bottom, i.e. at the foot of the user. After slight falling off, motion can then again be resumed.

The V-shaped arrangement of the boom struts 18, 20 also make it possible to let the foot point, i.e. the respective lower support point, blow to leeward so that in this manner the sailing pressure can also be adjusted. For this the sailing rig has to be held at the upper boom strut 18 and be lifted off from the foot so that the wind pressure can position the sail 4 correspondingly askew to the plane of drawing. In order to support jumps or the like, the sail can also be held like a wing above the user so that a lift is created.

The V-shaped structure of the holding means 8 with spaced boom struts 18, 20 thus allows it to tilt the sail around the middle axis 3 or to adjust the angle of attack correspondingly with the width of the V being selected such that the user can continuously apply the holding forces necessary without great efforts.

During the first preliminary tests, it was shown that during the use with roller skates a sail surface of approximately 3 $m^2$ at a rigging height of approximately 3 m and a length of the holding means 8 (distance of the base portion 30 from the trailing edge 10 along the middle line 3) of approximately 1.45 m represented an optimum compromise between reachable speed and minimal holding forces.

For folding the sailing rig 1, the trailing edge 10 is first detached from the boom strut 18 and subsequently the fixing pin 46 of the connecting means 24 is removed so that the two boom struts 18, 20 can be swivelled into the parallel position shown in FIG. 2. Subsequently, the two sliding sleeves 42 or the other elements used for arresting the joint device 28 are shifted so that the mast middle portions 38, 40 can be swivelled approximately at right angles to the base portion 30. in this, the sail 4 is also correspondingly folded. In the folded position, the mast middle portions 38, 40 and the boom struts 18, 20 take an approximately parallel spacing towards each other with optionally crossed end portions 14, 16. In this folded state, the complete rig 1 can be stored in a sail sack without detaching the sail so that the space needed and the effort of rigging is minimal. The storage space can be further reduced by removing the two end portions 14, 16 from the middle section 12 and storing them separately.

The rig is naturally not limited to the geometry shown in FIG. 1 but the mast could for example also be formed with a straight or arrow-shaped middle section. The shape of the sail is not limited to the geometry shown in FIG. 1, either. The holding means 8 can also be formed with two at least sectionally parallel boom struts or with boom struts arranged in another manner, with it being essential that sufficient tensile forces are transferred to the trailing edge 10 and that the user is provided with a sufficient lever for positioning the sail and for swivelling it in case of a change of direction. The supporting means 58, 60 can be formed in any manner, merely a suitable support at the body of the user has to be guaranteed. In case of particular cases of use, the support can also occur at a sporting device such as for example a sled or a wagon.

What is disclosed is a supporting frame for a hand-supported sailing rig in which a mast with a middle section curved in a preferably circular arc-shaped manner and merging into two end portions is formed, the radii of curvature of said end portions being smaller than the one of the middle section. The supporting frame has supporting means for supporting the rig at the body of the user. The middle section is preferably provided with a joint device which allows the arrangement of the supporting components in the folded state in a parallel orientation towards each other.

What is claimed is:

1. A supporting frame for a sailing rig wherein a holding means (8) running from a leading edge to a trailing edge (10) of a sail is arranged approximately in a plane of symmetry of the supporting frame, by means of which the sailing rig (1) is held and can be adjusted with respect to the wind, the part of the supporting frame (2) arranged in the leading edge area is formed by a mast (6) approximately having a U- or V-shape characterized in that, at each of the two end sections of the mast, supporting struts (58, 60) extending away from the mast (6) are provided for supporting the sailing rig (1) on a user's body or a sporting device.

2. A supporting frame according to claim 1, characterized in that said mast (6) has a middle section (12) formed in an approximately circular arc shape, which merges into two curved end pieces (14, 16).

3. A supporting frame according to claim 2, characterized in that said middle section (12) is formed in the shape of a circular arc, with the radius of curvature (R) being larger then those of the two end portions (14, 16).

4. A supporting frame according to claim 1, characterized in that said holding means (8) has two boom struts (18, 20) arranged in a V-shape and meeting towards the trailing edge (10), the front end sections of which are coupled at the mast (6) in spaced distance to each other and the back end sections of which are connected with each other in the area of the trailing edge (10).

5. A supporting frame according to claim 1, characterized in that a middle section (12) of said mast (6) has a connecting member (28, 70) separating it into a first and a second mast middle portion (38, 40).

6. A supporting frame according to claim 5, characterized in that said connecting member (28) has a base portion (30) with two distanced joints at which a first mast middle portion (38) or a second mast middle portion (40), respectively, is coupled.

7. A supporting frame according to claim 6, characterized in that said base portion (30) has a supporting shell (32, 34) at each end section, at which the allocated ends of the mast middle portions can be supported in the extended position.

8. A supporting frame according to claim 5, characterized in that said connecting member is an inserted connection (70) for connecting the mast middle portions (38, 40).

9. A supporting frame according to claim 4, characterized in that said back end sections of said boom struts (18, 20) are detachably connected with each other.

10. A supporting frame according to claim 2, characterized in that said middle section (12) of said mast (6) and said two circular arc shaped end portions (14, 16) are detachably connected with each other.

11. A supporting frame according to claim 1, characterized in that said supporting means are supporting struts (28, 60) extending away from the mast (6).

12. A supporting frame according to claim 4, characterized in that said boom struts (18, 20) bear an end fitting (26) at which said trailing edge (10) of said sail (4) can be fixed.

13. A supporting frame according to a combination of features of claim 6, characterized in that said connecting member (28) and said coupling of the boom struts (18, 20) is selected such that the supporting components of said supporting frame (2) are arranged approximately in parallel in a folding state of the supporting frame.

14. A supporting frame according to claim 1, characterized in that a line of connection through the two free ends of said two ends (14, 16) of said mast (6) runs approximately through the sail's pressure point (S).

15. A sailing rig with a supporting frame according to claim 1 at which a sail (4) is stretched, characterized in that the sail surface is approximately 3 $m^2$.

* * * * *